US010054411B2

(12) United States Patent
Quertelet

(10) Patent No.: US 10,054,411 B2
(45) Date of Patent: Aug. 21, 2018

(54) MISSILE PROVIDED WITH A SEPARABLE PROTECTIVE FAIRING

(71) Applicant: MBDA FRANCE, Le Plessis-Robinson (FR)

(72) Inventor: Clément Quertelet, Paris (FR)

(73) Assignee: MBDA FRANCE, Le Plessis-Robinson (FR)

( * ) Notice: Subject to any disclaimer, the term of this patent is extended or adjusted under 35 U.S.C. 154(b) by 0 days.

(21) Appl. No.: 15/318,378

(22) PCT Filed: Jun. 10, 2015

(86) PCT No.: PCT/FR2015/000114
§ 371 (c)(1),
(2) Date: Dec. 13, 2016

(87) PCT Pub. No.: WO2015/197922
PCT Pub. Date: Dec. 30, 2015

(65) Prior Publication Data

US 2017/0131076 A1 May 11, 2017

(30) Foreign Application Priority Data

Jun. 25, 2014 (FR) ..... 14 01421

(51) Int. Cl.
*F42B 10/46* (2006.01)
*F42B 15/36* (2006.01)

(52) U.S. Cl.
CPC ..... *F42B 10/46* (2013.01); *F42B 15/36* (2013.01)

(58) Field of Classification Search
CPC ..... F42B 10/46; F42B 15/34; F42B 15/36
(Continued)

(56) References Cited

U.S. PATENT DOCUMENTS 3,446,464 A * 5/1969 Donald ..... B64C 23/005 244/1 N
3,706,281 A * 12/1972 Hatakeyama ..... F42B 15/36 102/378

(Continued)

FOREIGN PATENT DOCUMENTS

EP 1013546 A2 6/2000
JP 11020798 A * 1/1999 ..... B64G 1/641

(Continued)

OTHER PUBLICATIONS

Written Opinion of the International Searching Authority in PCT/FR2015/000114; English Translation; dated Dec. 30, 2015.*

(Continued)

*Primary Examiner* — James S Bergin
(74) *Attorney, Agent, or Firm* — Patrick J. Daugherty; Driggs, Hogg, Daugherty & Del Zoppo Co., LPA

(57) ABSTRACT

The missile comprises at least one separable propulsion stage and a terminal vehicle arranged to the front of the separable propulsion stage, said missile being provided at the front with a separable protective fairing comprising at least two individual shells and with a connecting part connected to the missile towards the rear beyond the position of the rear end of the terminal vehicle. The protective fairing is configured such that, when mounted on the missile, it surrounds all of the terminal vehicle and it is connected at the rear end to the connecting part by means of articulated connecting elements.

10 Claims, 3 Drawing Sheets

(58) Field of Classification Search
USPC ..... 102/374, 377, 378, 293; 244/173.3, 244/173.1
See application file for complete search history.

(56) References Cited

U.S. PATENT DOCUMENTS 4,342,262 A * 8/1982 Romer ..... F42B 12/58 102/393
4,699,062 A 10/1987 Lewis et al.
5,529,264 A * 6/1996 Bedegrew ..... B64F 1/04 102/274
6,193,187 B1 * 2/2001 Scott ..... B64G 1/14 244/159.3
6,247,671 B1 * 6/2001 Saeks ..... B64C 23/005 244/130
6,371,412 B1 * 4/2002 Osterberg ..... B64G 1/641 244/1 N
6,494,406 B1 * 12/2002 Fukushima ..... B64G 1/002 244/173.3
9,329,007 B2 * 5/2016 Krauss ..... F42B 10/38
9,534,563 B2 * 1/2017 Facciano ..... F02K 9/76
2005/0000383 A1 * 1/2005 Facciano ..... F42B 10/46 102/377
2017/0167838 A1 * 6/2017 Quertelet ..... B64G 1/58

FOREIGN PATENT DOCUMENTS

JP 2015223963 A * 12/2015
RU 2072097 C1 * 1/1997
WO WO0134468 A1 5/2001

OTHER PUBLICATIONS

ISA/EP International Search Report dated Aug. 31, 2015 re PCT Application No. PCT/FR2015/000114, filed Jun. 10, 2015.

* cited by examiner

MISSILE PROVIDED WITH A SEPARABLE PROTECTIVE FAIRING

BACKGROUND

The present invention relates to a missile provided with a jettisonable or separable protective fairing.

BRIEF SUMMARY

Aspects include a missile comprising at least one separable propulsion stage (5) and a terminal vehicle (6) that is arranged to the front of the separable propulsion stage (5), said missile (1) being provided at the front with a separable protective fairing (2) comprising at least two individual shells (3, 4), characterised in that it comprises a connecting part (10A, 10B) connected to the missile (1), towards the rear beyond the position (P1) of the rear end (11) of the terminal vehicle (6), and in that said protective fairing (2), when it is fitted to the missile (1), surrounds the whole of said terminal vehicle (6) and is connected by a rear end to the connecting part (10A, 10B) by means of articulated connecting elements (7).

In some Missile aspects said connecting part (10A, 10B) has the general shape of a ring.

3 In some Missile aspects said connecting part (10A) is an intermediate part (15) of the body of the missile (1), which is arranged between the terminal vehicle (6) and the propulsion stage (5).

In some Missile aspects the intermediate part (15) is capable of being separated from said terminal vehicle (6).

In some Missile aspects a protective fairing (2), said connecting part (10B) and said rotary connecting elements (7) form a monobloc assembly (16), said connecting part (10B) being capable of being fixed to a portion called a support portion (18) of the missile (1).

In some Missile aspects a support portion (18) is an intermediate part of the body of the missile (1), which is arranged between the terminal vehicle (6) and the propulsion stage (5).

Some Missile aspects include at least one internal pressure regulation unit (20).

In some Missile aspects said internal pressure regulation unit (20) comprises at least one valve (24) arranged in at least one channel (21) generating a passage of air between the interior (22) of the protective fairing (2) and the exterior (23) of the missile (1).

In some Missile aspects said at least one channel (21) is made in said intermediate part (15, 18).

In some Missile aspects said intermediate part (15, 18) is configured to support the terminal vehicle (6) and comprises elements for the ejection of same.

Some Missile aspects have intermediate support elements (26) arranged between the protective fairing (2) and the terminal vehicle (6), said intermediate support elements (26) being fixed to an internal face (2A) of the protective fairing (2) and being in contact with an external face (6A) of the terminal vehicle (6).

Some Missile aspects have at least one system (28) for absorbing shear forces between the shells (3, 4) of the protective fairing (2).

Some Missile aspects have means (32) configured to create electrical continuity between adjacent electrically-conductive shells (3, 4) of the protective fairing (2).

BRIEF DESCRIPTION OF THE DRAWINGS

The accompanying drawings will give a clear understanding as to how the invention can be embodied. In these drawings, identical references refer to similar elements.

DETAILED DESCRIPTION

Figure 1:
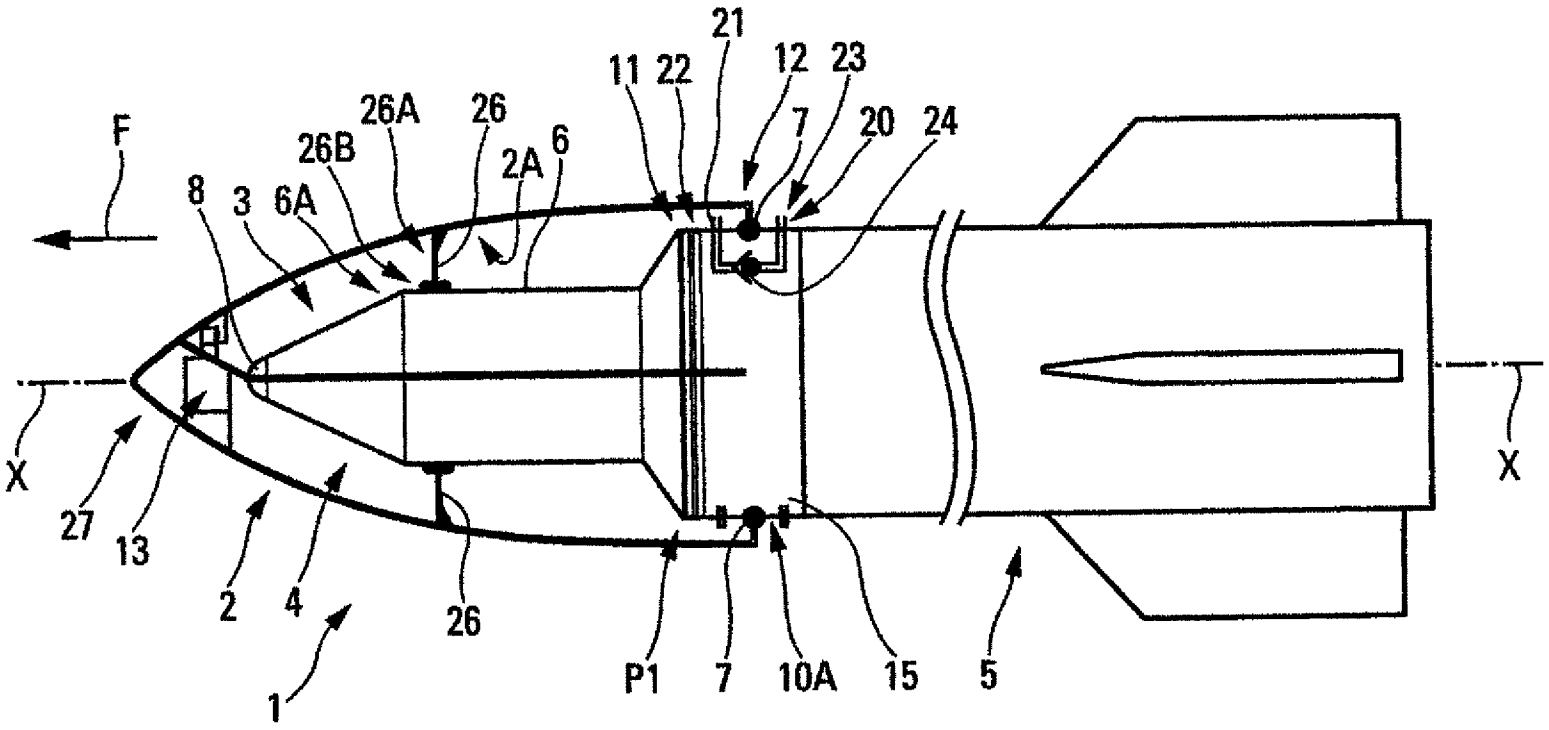
FIGS. 1 and 2 represent diagrammatically an example of a missile to which the present invention is applicable, provided with a protective fairing that is, respectively, in a fitted position on the missile and in a jettisoned or open position.

More specifically, the present invention is applicable to a missile comprising at least one propulsion stage that is intended to propel the missile and which can be separated therefrom, and also a terminal vehicle that is arranged to the front of this propulsion stage and which makes a terminal flight towards a target. Generally, such a terminal vehicle comprises at least one sensor forming for example part of a homing device, which is temperature-sensitive.

The present invention is applicable more particularly, although not exclusively, to a missile with a flight envelope that remains within the atmosphere and whose kinetic performance characteristics enable the terminal vehicle to be brought to hypersonic speeds. At these high speeds, the surface temperature of the missile can reach several hundred degrees Celsius under the effect of aerothermodynamic flow, which can be prejudicial to the behaviour and the performance characteristics of the structures, and of the items of electronic equipment and sensors present.

Therefore, a missile is generally provided at the front with a protective fairing, which generally comprises a plurality of individual shells and which is intended to provide thermal and mechanical protection for the terminal vehicle. This protective fairing must be capable of being removed at the appropriate moment, in particular to enable the sensor placed on the terminal vehicle to be used in the terminal phase of the flight.

A localised protective fairing is often provided which is therefore relatively light. However, it is then necessary to provide direct thermal protection for the parts of the terminal vehicle that are not covered by the protective fairing. The assembly is generally lighter, but once the terminal vehicle is without a fairing, its agility is penalised by the mass of these thermal protection elements.

In particular, an architecture that makes provision for the shells of the protective fairing to be articulated on the terminal vehicle creates a significant residual mass on the vehicle, due in particular to the mass of the hinges or shell articulations used for that purpose, and penalises its performance characteristics during the terminal flight.

The aim of the present invention is to overcome this disadvantage. The invention relates to a missile comprising at least one separable propulsion stage and a terminal vehicle that is arranged to the front of the propulsion stage, said missile being provided at the front with a separable (or jettisonable) protective fairing comprising at least two individual shells.

According to the invention, said missile comprises a connecting part connected to said missile, towards the rear beyond the position of the rear end of the terminal vehicle, and said protective fairing, when it is fitted to the missile, surrounds the whole of said terminal vehicle and is connected by a rear end to the connecting part by means of articulated connecting elements.

Thus, by virtue of the invention, a protective fairing is provided that is encompassing, i.e. that completely surrounds the terminal vehicle in the normal protection position. Such an encompassing protective fairing is certainly larger and therefore heavier than a localised protective fairing, but this structure with an encompassing fairing that is connected to the missile, towards the rear beyond the position of the rear end of the terminal vehicle (via the connecting part) minimises the residual mass on the vehicle terminal after separation, as detailed below. This minimisation of the mass maximises the performance characteristics of the terminal vehicle in the terminal phase (which is the most sensitive).

It will be noted that:

- a localised protective fairing is lighter than an encompassing protective fairing as mentioned above, but it requires the provision of thermal protection for all parts of the terminal vehicle that will not be covered by the protective fairing. The assembly is generally lighter, but once the terminal vehicle is without a fairing, its agility is penalised by the whole weight of the thermal protection that has become superfluous; and
- any loss of performance of the missile in the first phase of the launch, with an encompassing protective fairing that is heavier than a localised protective fairing, can be compensated for by, in particular, one or more than one propulsion stage that is more efficient.

Advantageously, said connecting part has the general shape of a ring.

In a first embodiment, said connecting part is an intermediate part of the body of the missile, which is arranged between the terminal vehicle and the propulsion stage. Advantageously, this intermediate part is capable of being separated from said terminal vehicle.

In a second embodiment, the protective fairing, the connecting part and the rotary connecting elements (in particular some hinges) form a monobloc assembly, the connecting part being capable of being fixed to a portion called a support portion of the missile. Preferably, this support portion is an intermediate part of the body of the missile, which is arranged between the terminal vehicle and the propulsion stage, and which is capable of being separated from said terminal vehicle.

Furthermore, in a particular embodiment, the missile has at least one internal pressure regulation unit. Advantageously, this internal pressure regulation unit comprises at least one valve arranged in at least one channel generating a passage of air between the interior of the protective fairing and the exterior of the missile. Preferably, said at least one channel is made in said intermediate part.

As, because of the aerothermodynamic flow (in the case of supersonic missiles for example) and the flight altitude that are likely to be encountered by the missile, the difference in pressure between the interior and the exterior of the protective fairing can be significant, the internal pressure regulation unit prevents the fairing from deforming in flight and creates an opening allowing entry of the aerothermodynamic flow capable of damaging structures, items of equipment and a sensor of the terminal vehicle.

In addition, advantageously, said intermediate part is configured to support the terminal vehicle and comprises elements for the ejection of same.

Furthermore, in a particular embodiment, the missile has intermediate support elements arranged between the protective fairing and the terminal vehicle, these intermediate support elements being fixed to an internal face of the protective fairing and being simply in contact with an external face of the terminal vehicle.

Thus, by virtue of this particular embodiment:

- either the terminal vehicle is prevented from flexing inside the protective fairing;
- or the terminal vehicle also plays a part in holding the protective fairing, which ensures a reasonable dimensioning (sufficiently low mass) of the fairing.

In addition, advantageously, the missile also has at least one system for absorbing shear forces between the shells of the protective fairing. By virtue of this system, the shells do not have to be too thick (and therefore too massive) to be able to benefit from an adequate rigidity.

In addition, advantageously, the missile also has means configured to create electrical continuity between adjacent electrically conductive shells of the protective fairing, which provide, in particular, electromagnetic protection.

Figure 2:
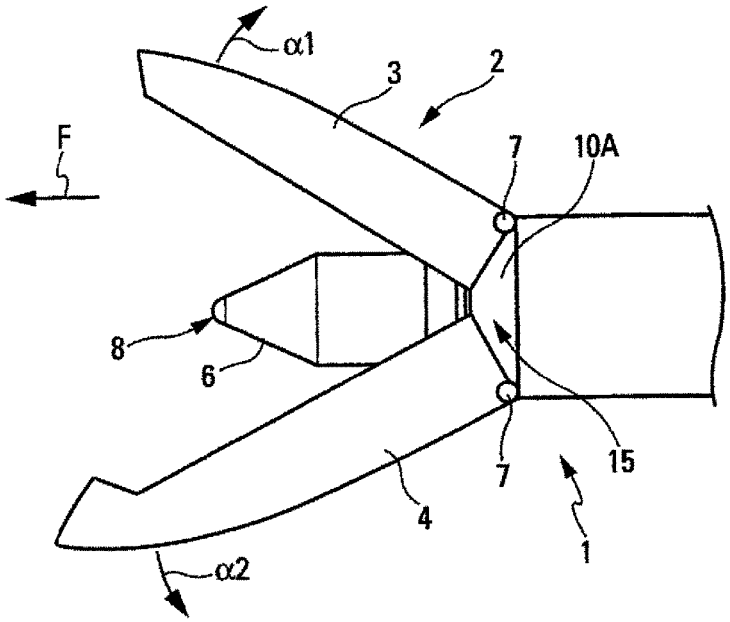

The present invention is applicable to a missile 1 represented diagrammatically in FIGS. 1 and 2, which is provided to the front (in the direction of travel F of said missile 1) with a protective fairing 2. This protective fairing 2 has a plurality of shells 3 and 4, in this case, two shells 3 and 4 in the example shown in FIGS. 1 to 4.

The missile 1, with a longitudinal axis X-X, comprises at least one jettisonable propulsion stage 5 (to the rear) and a terminal vehicle 6 that is arranged to the front (in the direction of travel F) of this propulsion stage 5.

In general, a flying terminal vehicle 6 of this kind comprises, in particular, at least one sensor 8 arranged to the front, forming for example part of a homing device and capable of being temperature-sensitive. The propulsion stage 5 and the terminal vehicle 6 can be of any standard type and are not described any further in the description that follows.

Usually, the propulsion stage or stages 5 of such a missile 1 are intended for the propulsion of said missile 1, from firing until a target (that has to be neutralised by the missile 1) is close. The terminal phase of the flight is completed autonomously by the terminal vehicle 6, which uses in particular information originating from the on-board sensor 8, for example an optoelectronic sensor intended to assist in detecting the target. In order to do this, the terminal vehicle 6 comprises all the standard means (not further described), which are necessary to complete this terminal flight. Before the terminal phase is started, the protective fairing 2 is jettisoned or at least opened, after a separation of the different shells 3 and 4, for example by pivoting, in order to release the (flying) terminal vehicle 6 that then separates from the rest of the missile 1.

The missile 1 is therefore provided at the front with a separable protective fairing 2 that is intended, in particular, to provide thermal and mechanical protection for the terminal vehicle 6. This protective fairing 2 must, however, be capable of being removed at the appropriate moment, in particular to allow the sensor 8 placed on the terminal vehicle 6 to be used in the terminal phase of the flight.

In the situation in FIG. 1, the protective fairing 2 is fitted to the missile 1 in an operating (or protection) position. The terminal vehicle 6 is fitted inside the protective fairing 2 which is represented by a thick line.

Figure 3:
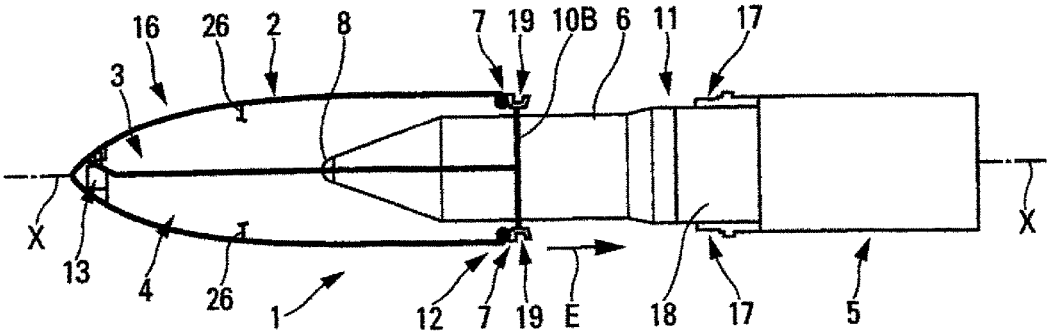
FIGS. 3 and 4 represent diagrammatically a particular embodiment of the fairing according to the present invention, in a fitting position and a fitted position respectively.
Figure 4:
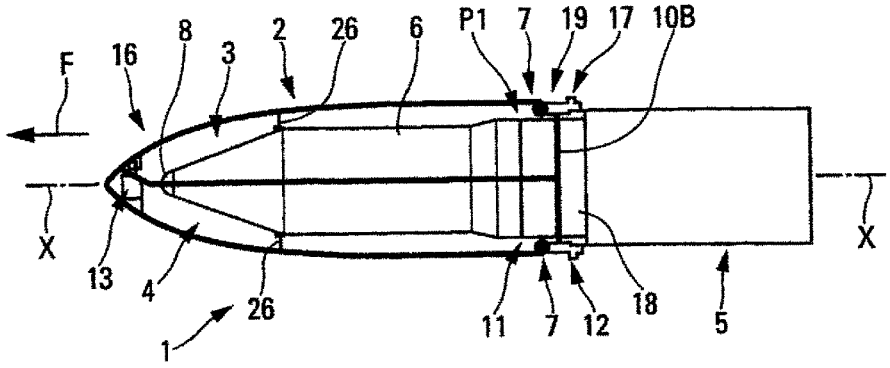

In addition, in the situation shown in FIG. 2, the shells 3 and 4 are in the course of separating, for example by being pivoted by rotary connecting elements 7 represented diagrammatically in FIG. 2, as illustrated by arrows $\alpha 1$ and $\alpha 2$ respectively, during a phase of opening or of jettisoning of the protective fairing 2. The release of the shells 3 and 4 and the impetus to generate the movements illustrated by the arrows α1 and α2 can be produced by an appropriate system 13, for example a pyrotechnic actuator preferably arranged to the front of the fairing 2 (inside said fairing), as shown in FIGS. 1, 3 and 4. This phase of opening or jettisoning the protective fairing 2 releases the terminal vehicle 6, which can for example be ejected out of the missile 1 using appropriate ejection means (not shown).

The present invention can be applied more particularly, although not exclusively, to a missile 1 with a flight envelope remaining in the atmosphere and which has kinetic performance characteristics that allow the terminal vehicle 6 to be brought to hypersonic speeds. At these high speeds, the surface temperature of the missile 1 can reach several hundred degrees Celsius under the effect of aerothermodynamic flow, which makes it necessary to provide a protective fairing 2 which is efficient in making possible the resistance and performance characteristics of the structures, of the items of electronic equipment and of the on-board sensors.

According to the invention, said missile 1 comprises a connecting part 10A, 10B connected to the missile 1, towards the rear (in the direction opposite the direction of travel F) beyond the position P1 of the rear end 11 of the terminal vehicle 6 when it is fitted to the missile 1.

In addition, according to the invention, when the protective fairing 2 is fitted to the missile 1 said fairing surrounds the whole of said terminal vehicle 6 and is connected by a rear end 12 to the connecting part 10A, 10B by means of articulated connecting elements 7, in particular hinges or other standard rotary elements.

The protection offered by the protective fairing 2 therefore benefits not only the sensor 8, but also the whole of the terminal vehicle 6. The protective fairing 2 encompasses the whole of the terminal vehicle 6 and it is removed just before the use of the sensor 8 and the autonomous flight of the terminal vehicle 6. As the duration of the autonomous flight of the terminal vehicle 6 (with use of the sensor 8) is short, it is therefore possible to do without thermal protection during the terminal phase of the flight. Thus, by virtue of this encompassing protective fairing 2, which is removed before the autonomous flight of the terminal vehicle 6, the mass related to the protective function (necessary only before this autonomous flight) is not allocated to the terminal vehicle 6.

Said connecting part 10A has the general shape of a ring, the outer diameter of which is substantially equal to the diameter of the body of the missile 1 at the portion where this connecting part 10A is provided.

In a first embodiment shown in FIG. 1, the connecting part 10A is an intermediate part 15 of the body of the missile 1, which is arranged between the terminal vehicle 6 and the propulsion stage 5. This intermediate part 15 is capable of being separated from said terminal vehicle 6.

The shells 3 and 4 of the protective fairing 2 are thus articulated on the intermediate part 15 and the associated connecting means, in particular the rotary connecting elements 7, are integral with this intermediate part 15 which can separate from the terminal vehicle 6 before the autonomous flight of said vehicle.

This embodiment allows in particular:

- a manufacturing division between the different subsystems (protective fairing 2, terminal vehicle 6, intermediate part 15 and propulsion stage(s) 5);
- the terminal vehicle 6 to be supported and ejection systems (not shown) to be integrated into said vehicle; and
- the incorporation of an internal pressure regulation unit 20, detailed below, distant from the aerothermodynamic flow (i.e. distant from the nose 27 of the protective fairing 2), for greater effectiveness.

In a second embodiment (shown in FIGS. 3 and 4), the protective fairing 2, the connecting part 10B (made in the form of a ring or collar) and the rotary connecting elements 7 form a monobloc assembly 16. In order to detail this monobloc assembly 16 properly, it is shown:

- in a fitting position in FIG. 3, the assembly 16 being moved towards the rear in direction E, coaxially with the axis X-X, until its rear end 12 reaches the correct position. It is then fixed to the missile 1; and
- in a fitted position in FIG. 4. In this fitted position, the connecting part 10B is fixed to support means 17 of a support portion 18 of the missile 1, via appropriate fixing means 19. Any type of support means 17 and fixing means 19, standard and cooperating, capable of providing a satisfactory fixing of the assembly 16 to the missile 1, can be contemplated.

Preferably, the support portion 18 is an intermediate part of the body of the missile 1, which is arranged between the terminal vehicle 6 and the propulsion stage 5, for example in a manner similar to the intermediate part 15 of the first embodiment mentioned above.

This second embodiment facilitates the manufacture and the integration of the protective fairing 2. In addition, by adapting the connecting part 10B and possibly the fixing means 19, the assembly 16 can easily be adapted to different types of missile that exist.

Furthermore, in a particular embodiment, the missile 1 has at least one internal pressure regulation unit 20. As shown diagrammatically in FIG. 1, this internal pressure regulation unit 20 comprises at least one channel 21 creating a passage of air between the interior 22 of the protective fairing 2 and the exterior 23 of the missile 1, and at least one valve 24 which is arranged in said channel 21.

In a particular embodiment, the channel or channels 21 are made in said intermediate part 15 as shown in FIG. 1, or in the intermediate part 18 of FIGS. 3 and 4. Thus, the internal pressure regulation unit 20 is arranged distant from the aerothermodynamic flow (i.e. distant from the nose 27 of the protective fairing 2), which increases the effectiveness.

The valve 24 can, for example, be formed by a ball and a return spring for same, dimensioned so that the internal pressure in the protective fairing 2 never exceeds a predetermined threshold (for example a few millibars). Other standard embodiments of valve architecture can be used.

As the difference in pressure between the interior 22 and the exterior 23 of the protective fairing 2 can be significant, because of the aerothermodynamic flow (in the case of supersonic missiles for example) and the flight altitude likely to be encountered by the missile 1, the internal pressure regulation unit 20 prevents the protective fairing 2 from deforming in flight and creates an opening allowing entry of the aerothermodynamic flow capable of damaging the structures, items of equipment and in particular the sensor 8 of the terminal vehicle 6.

Consequently, in such an embodiment, as shown in FIG. 1, the intermediate part 15 forms the interface with the propulsion stage 5 and the junction with the terminal vehicle 6, and serves as a passage for the channel 21 and also as a hinge support for the protective fairing 2.

In a particular embodiment, the intermediate part 15, 18 is configured in order to support the terminal vehicle 6, and is provided with standard ejection elements (not shown) to eject same.

Furthermore, in a particular embodiment, the missile 1 has intermediate support elements 26 that are arranged between the protective fairing 2 and the terminal vehicle 6 in the fitted position of FIGS. 1 and 4. These intermediate support elements 26 are:

firstly, fixed (by means of an end 26A) to an internal face 2A of the protective fairing 2, as shown in FIG. 1; and secondly, simply in contact (by means of the other end 26B) with an external face 6A of the terminal vehicle 6, for example via an appropriate sole plate or base.

Thus, by virtue of this particular embodiment, the terminal vehicle 6 also plays a part in holding the protective fairing 2, which ensures reasonable dimensioning (sufficiently low mass) thereof.

With this particular embodiment, in a variant, the protective fairing 2 can be provided with a significant rigidity so as to prevent, using intermediate support elements, the terminal vehicle 6 (that has in particular a large dimension) from flexing inside the protective fairing 2.

In the second embodiment shown in FIGS. 3 and 4, these intermediate support elements 26 form part of the monobloc assembly 16.

Figure 5:
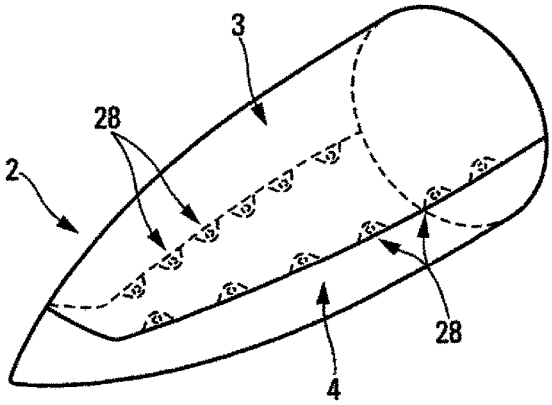
FIGS. 5 and 6 represent diagrammatically an example of means of a system for absorbing shear forces between shells of the protective fairing, over the whole of the protective fairing and over an enlarged portion of the protective fairing respectively.
Figure 6:
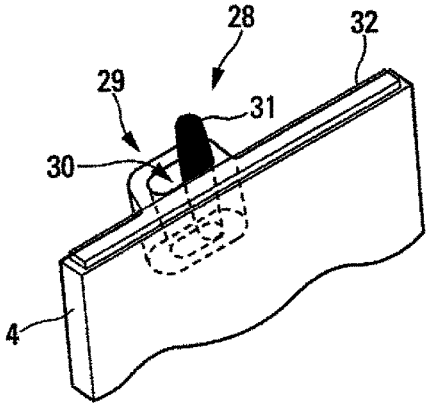

Furthermore, the missile 1 also has at least one system 28 for absorbing shear forces between the shells 3 and 4 of the protective fairing 2, as shown in FIGS. 5 and 6.

This system 28 absorbs the shear forces between the shells 3 and 4, which therefore do not have to be thick (and therefore too massive) to benefit from an adequate rigidity.

In the particular embodiment (given as an example) in FIGS. 5 and 6, this system 28 comprises a plurality of connection positions 29 distributed along the junction between the two shells 3 and 4.

Each of these connection positions 29 comprises:

an oblong recess 30 made in a shell 4 along the length of its wall; and a lug 31 that is fixed to the other shell 3, and which is movable in the oblong recess 30 along the length of the wall, but which prevents a transverse movement.

Within the scope of the present invention, other types of junction between the shells 3 and 4 of the protective part 2 are possible. In particular, it is possible to envisage an internal covering, with edges that have cooperating shapes or with a mortice/tenon type connection, over the entire periphery of the junction or over a large portion thereof.

Furthermore, in a particular embodiment, the shells 3 and 4 of the protective fairing 2 are electrically conductive, either by being made of an electrically conductive material, or by comprising means for electrical conduction. Several different means for doing this can be envisaged, such as a metal film or a metal braid that covers a structural portion of each of the shells.

In this particular embodiment, the missile 1 also has means to provide electrical continuity between the electrically conductive shells 3 and 4 of the protective fairing 2. These means can have, as shown by way of example in FIG. 6, a joint 32, in particular a filled elastomer or a metal braid, which is arranged at the junction between the two shells 3 and 4 so as to produce electrical continuity.

Within the scope of the present invention, other variants are also possible in order to provide electrical continuity. In particular, an electrically conductive element (or plate), which connects two shells on the inside while covering the junction, can be considered.

This particular embodiment prevents electrical arcs from being produced at the junction and provides electromagnetic protection.

By virtue of the invention, a protective fairing 2 is therefore provided that is encompassing, i.e. that completely surrounds the terminal vehicle 6 in the normal protection position. Such an encompassing protective fairing 2 is certainly heavier than a localised protective fairing, but it minimises the residual mass on the terminal vehicle 6 after separation, since the means 7, 26 for protection and articulation of the shells 3 and 4 are integral not with the terminal vehicle 6 but with the jettisoned elements. This minimisation of the weight maximises the performance characteristics of the terminal vehicle 6 in the terminal phase (the most sensitive phase).

It will be noted that any loss of performance by the missile 1 in the first phase of the launch, with an encompassing protective fairing 2 that is heavier than a localised protective fairing, can be compensated for by, in particular, the provision of one or more than one propulsion stage 5 that is more effective.

The encompassing architecture of the protective fairing 2, as described above, also has the following advantages (in comparison with a more localised protective fairing):

increased protection; and greater flexibility in the changes to the embodiment of the terminal vehicle 6 and/or the propulsion stage 5.

The invention claimed is:

1. A missile, comprising:

a separable propulsion stage that is located at a rear end of a missile along a longitudinal axis of the missile relative to a direction of travel of the missile driven by action of the separable propulsion stage;

a terminal vehicle that is located at a front end of the missile along the longitudinal axis relative to the direction of travel of the missile;

an intermediate body part that is located between the separable propulsion stage and the terminal vehicle and is connected to a front end of the separable propulsion stage relative to the direction of travel of the missile, and to a rear end of the terminal vehicle relative to the direction of travel of the missile, wherein the intermediate body part is configured to separate from said terminal vehicle prior to autonomous flight of the terminal vehicle;

a connecting part connected to the intermediate body part at a location along the longitudinal axis that is towards the rear end of the missile relative to the terminal vehicle that is beyond a position of the rear end of the terminal vehicle toward the rear end of the missile along the longitudinal axis; and a separable protective fairing that comprises at least two individual shells, wherein said protective fairing, when it is fitted to the missile, surrounds a whole of said terminal vehicle and is connected to the intermediate body part via the connecting part by means of articulated connecting elements that are located at a rear end of the separable protective fairing relative to the longitudinal axis and the direction of travel of the missile.

2. The missile according to claim 1, wherein said connecting part has a general shape of a ring defined by an outer diameter that is substantially equal to a diameter of the intermediate body part.

3. The missile according to claim 1, wherein separation of the at least two shells by rotation of the articulated connecting elements about the connecting part releases the terminal vehicle to separate from the intermediate body part prior to the autonomous flight of the terminal vehicle.

4. The missile according to claim 1, wherein the articulated connecting elements are rotary connecting elements; and wherein said protective fairing, said connecting part and said rotary connecting elements form a monobloc assembly, said connecting part being capable of being fixed to a support portion of the missile.

5. The missile according to claim 1, further comprising:

at least one internal pressure regulation unit that is located within the intermediate body part at a location along the longitudinal axis that is towards the rear end of the missile relative to the terminal vehicle that is beyond the position of the rear end of the terminal vehicle toward the rear end of the missile along the longitudinal axis, and that is distant from an aerothermodynamic flow at a nose of a front end of the protective fairing relative to the longitudinal axis.

6. The missile according to claim 5, wherein said internal pressure regulation unit comprises at least one valve arranged in at least one channel configured to generate a passage of air between an interior of the protective fairing and an exterior of the missile.

7. The missile according to claim 1, wherein said intermediate part is configured to support the terminal vehicle and comprises elements for the ejection of same.

8. The missile according to claim 1, further comprising:

intermediate support elements arranged between the protective fairing and the terminal vehicle, said intermediate support elements being fixed to an internal face of the protective fairing and being in contact with an external face of the terminal vehicle.

9. The missile according to claim 1, further comprising:

at least one system for absorbing shear forces between the shells of the protective fairing comprising:

a plurality oblong recesses formed in a first wall of a first of the at least two individual shells and distributed along a length of the first wall; and a plurality of lugs that are fixed to a second wall of a second of the at least two individual shells and distributed along a length of the second wall;

wherein in installation upon the intermediate body part the first wall and the second wall form a junction wherein each the lugs is located within one of the oblong recesses, wherein the lugs are movable within the oblong recesses along the length of the first wall, and wherein engaged of the lugs with walls of the oblong recesses prevents a transverse movement of the first wall relative to the second wall.

10. The missile according to claim 1, wherein the at least two shells are electrically conductive, further comprising:

means configured to create electrical continuity between adjacent electrically-conductive shells of the at least two shells of the protective fairing that are selected from the group consisting of a conductive filled elastomer arranged at a junction of the shells, and a conductive metal braid at the junction between the shells.

* * * * *